United States Patent [19]

Sanderson

[11] Patent Number: 4,541,944

[45] Date of Patent: Sep. 17, 1985

[54] COMPOSITIONS AND PROCESSES EMPLOYING ACTIVATORS FOR THE GENERATION OF PEROXYACIDS

[75] Inventor: William R. Sanderson, Warrington, England

[73] Assignee: Interox Chemicals Limited, London, England

[21] Appl. No.: 598,009

[22] Filed: Apr. 9, 1984

[30] Foreign Application Priority Data

Apr. 14, 1983 [GB] United Kingdom ..... 8310081

[51] Int. Cl.[3] ..... C11D 7/38; C11D 7/54

[52] U.S. Cl. ..... 252/95; 252/99; 252/106; 252/186.38; 252/186.41; 260/410.6; 560/1; 560/105; 560/112; 560/185; 560/198; 560/262; 560/263

[58] Field of Search ..... 252/95, 99, 106, 186.38, 252/186.41; 260/410.6; 560/105, 112, 185, 198, 262, 263, 1

[56] References Cited

U.S. PATENT DOCUMENTS

| | | | |
|---|---|---|---|
| 3,338,839 | 8/1967 | MacKellar et al. | 252/99 |
| 4,259,201 | 3/1981 | Cockrell et al. | 252/103 |
| 4,283,301 | 8/1981 | Diehl | 252/102 |
| 4,337,164 | 6/1982 | Clements | 252/96 |
| 4,391,725 | 7/1983 | Bossu | 252/90 |
| 4,412,934 | 11/1983 | Chung et al. | 252/186.38 |
| 4,483,778 | 11/1984 | Thompson et al. | 252/94 |

FOREIGN PATENT DOCUMENTS

| | | |
|---|---|---|
| 3003351 | 8/1981 | Fed. Rep. of Germany . |
| 56887 | 6/1974 | Japan . |
| 655040 | 7/1951 | United Kingdom . |
| 954418 | 8/1982 | U.S.S.R. . |

*Primary Examiner*—Prince E. Willis

*Attorney, Agent, or Firm*—Larson and Taylor

[57] ABSTRACT

Hydrogen peroxide and persalt washing or disinfecting compositions perform comparatively ineffectively at ambient to low operating temperatures. More effective washing/disinfection processes are obtained by employing according to the instant invention there with a peroxyacid generator selected from compounds having the general formula (I):

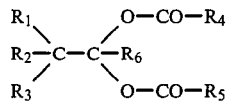

(I)

in which $R_1$ and $R_2$ and $R_3$ often are hydrogen, $R_6$ is often hydrogen or methyl and $R_4$ and $R_5$ are often methyl or phenyl. $R_3$ or $R_5$ can each also represent a difunctional group terminating at its other end in a second gem-diester group or in an enol ester group. Especially preferred peroxyacid generators include 1,1,5-triacetoxypent-4-ene, 1,1,5,5-tetraacetoxy pentane, the corresponding butene and butane compounds, ethylidene benzoate acetate and bis(ethylidene acetate) adipate.

46 Claims, No Drawings

COMPOSITIONS AND PROCESSES EMPLOYING ACTIVATORS FOR THE GENERATION OF PEROXYACIDS

The present invention relates to peroxygen compounds and more particularly to the generation of organic peroxyacids from activators, and in addition to compositions containing such activators and the use of such activators and compositions containing them inter alia for cleaning, bleaching or disinfection.

For many years, it has been common for many washing or disinfecting compositions for the European market to contain a peroxygen compound, which can act as an oxidising agent, a bleach and to at least some extent a disinfectant. Particularly for washing or bleaching compositions, the peroxygen compound has typically been a particulate alkali metal persalt such as sodium perborate tetrahydrate or sodium percarbonate which generates hydrogen peroxide in aqueous solution. Similarly, in America, peroxygen compound-containing additives are widely available for use in conjunction with other washing compositions. Persalts function more effectively at temperatures in excess of 80° C., but in recent years there has been a trend towards the use of synthetic fibres for apparel and household textile wares which may themselves, or their finishes or dyes, be adversely affected by exposure to high washing temperatures, and accordingly, increasing interest is being shown in washing at lower temperatures, for example in the range of ambient to 60° C. Interest has been further intensified by substantial increases in the cost of energy since the mid 1970's. For a peroxygen compound to be effective at such lower temperatures, it is necessary for it to be more active than aforementioned persalts, and accordingly considerable research effort has been directed by many organisations to locate either more active peroxygen compounds or compounds which can be added to persalts in order to activate them, i.e. activators. Both approaches suffer from their own disadvantages. The use of activators can be hindered by segregation of them from persalt during storage or transportation thereby leading to inconsistent washing performance, the need for both components to be dissolved simultaneously during the washing performance can lead to incomplete development of the active system during the restricted washing period available in most washing machines, and many can interact destructively with various other components in washing compositions. On the other hand, the more active peroxygen compounds are not without problems. First, many of them are comparatively unstable, even when stored alone, and this instability is compounded by the formulation with the rest of the washing compositions and many of such compounds are somewhat hazardous to handle, being sensitive to thermal shock, impact or other disturbance. In view of the problems associated with the existing active systems, there is a continuing need for alternatives having advantageous combinations of properties to be located.

One class of compound to which some attention was given during the early days of finding activators is that of carboxylic acid esters. One of the earliest of these is the British Pat. No. 836988 and the corresponding U.S. Pat. No. 2,955,905 which proposes the use of esters giving a titre of above a predetermined value of 1.5 mls in an arbitrary test. Surprisingly the instant inventor has found that certain esters described herein fail the aforementioned test, often providing titres of below half the pass value but can act as effective activators, thereby indicating that the test cannot be applied indiscriminately, requiring additional information that is not provided in the specification to validate the test. In addition to the test, the specification discloses that the esters should not yield easily oxidisable hydrolysis products such as unsubstituted lower aliphatic aldehydes. Subject to the foregoing directive, the specification lists seven various named sub-classes of esters which can be employed, naming examples within each and of course those examples do not include any reference to esters that might yield unsubstituted lower aliphatic aldehydes. One of the seven sub-classes of compounds, sub-class (e), is a sub-class not given undue prominence, and which comprise compounds containing two ester groups attached to the same carbon atom as may be obtained by acylation of aldehydes and five examples were given, including benzaldehyde diacetate and glycolic aldehyde triacetate. The inventor of the instant invention tested the aforementioned compounds in the course of his investigations into activators, and found that though they were initially solid products, exposure to ambient air led rapidly to the evolution of an unpleasant odour and liquefaction of the solids indicating that the compounds were particularly unstable upon storage or exhibited unpleasant storage characteristics. Accordingly, it will be recognised that the aforementioned patent specification does not give clear guidance as to the practical value or otherwise of various ester compounds except to discourage the use of those derivable from unsubstituted lower aliphatic aldehydes.

According to one aspect of the present invention, there is provided a process for the generation of a peroxyacid species comprising the step of bringing into contact hydrogen peroxide or an adduct thereof or some other compound which develops hydrogen peroxide with a peroxyacid generator having the general formula (I)

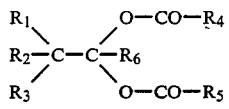

(I)

in which $R_1$ $R_2$ and $R_6$ are each selected from hydrogen and lower alkyl groups, and $R_3$ is selected from hydrogen, lower alkyl and aryl groups and groups of formula (II) or (III)

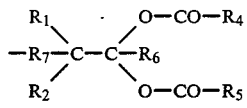

(II)

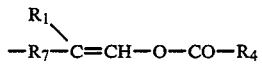

(III)

in which $R_7$ represents a carbon-carbon bond or an alkylene diradical, $R_4$ and $R_5$ each represent hydrogen or a lower alkyl, or an aryl, aralkyl or alkaryl group and $R_5$ can also be selected from groups of formula (IV) $—R_8—CO—O—R_9$ in which $R_8$ represents an alkylene diradical and $R_9$ represents a vinyl or alkyl substituted vinyl group or group of formula (V)

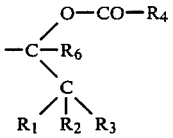

(V)

By so bringing the two aforementioned reagents into contact, it has been found that peroxyacid having the formula $R_4CO_3H$ or $R_5CO_3H$ can readily be obtained. These peroxyacid species being more active than hydrogen peroxide are particularly useful for bleaching, oxidising or for disinfecting/sanitisation.

According to a second aspect of the present invention there is provided a composition comprising (a) hydrogen peroxide or an adduct thereof or a compound which develops hydrogen peroxide and (b) a peroxyacid generator having the general formula (I) described hereinbefore. In certain embodiments, the composition is formed at the point of use, and in other embodiments the composition is formed as a storable solid or liquid.

In the peroxyacid generators, $R_1$, $R_2$ and $R_3$ can be the same as each other except where $R_3$ is selected from the additional groups or can differ and similarly $R_4$ and $R_5$ can be the same as each other except when one is selected from the additional groups or be different. Commonly, at least one of $R_1$, $R_2$, $R_3$ and $R_6$ is hydrogen. In many desirable embodiments, $R_1$, $R_2$ and $R_3$ each represent hydrogen, $R_6$ represents hydrogen or methyl or ethyl and $R_4$ and $R_5$ are selected from lower alkyl, particularly $C_1$ to $C_3$ and aryl, in particular phenyl and lower alkyl substituted phenyl. Expressed differently, one of $R_4$ and $R_5$, in some desirable embodiments, comprises a $C_1$–$C_3$ alkyl group and the other represents a $C_6$–$C_{10}$ alkyl or aryl group, including the aforementioned phenyl and substituted phenyl groups and $C_6$, $C_7$, $C_8$ chain length alkyl groups, optionally substituted by an ethyl or methyl groups. Where $R_4$ differs from $R_5$ two different peroxyacids are produced. Thus, advantageously, such gem diesters enjoy the advantage of being able to generate two different types of peroxyacid simultaneously thereby to cater for a broader range of stains without any problems associated with incorporating a mixture of activators, such as a mixture of hydrophilic and hydrophobic stains. Especially desirable peroxyacid generators include ethylidene diacetate, ethylidene dibenzoate and ethylidene acetate benzoate and the corresponding isopropylidene esters. Other generators include ethylidene or isopropylidene gem diesters in which one of the ester groups is acetate or propionate and the other is cyclohexanecarboxylate, hexanoate, heptanoate, octanoate, 2-ethyl-hexanoate or 3,5,5-trimethylhexanoate.

In other desirable embodiments in which $R_3$ represents a group of formula (II) or (III), the diradical terminates in a gem-diester or alternatively in an enol ester. In such compounds, $R_7$ often contains up to 8 and particularly 1, 2 or 3 linear carbon atoms. Suitably, groups $R_4$ and $R_5$ can be selected as before. Consequently, highly desirable peroxyacid generators include 1,1,4,4-tetra acetoxybutane and 1,1,5,5-tetra acetoxypentane together with 1,1,4,-triacetoxy but-3-ene and 1,1,5,-triacetoxypent-4-ene. In yet further embodiments, in which at least one of $R_4$ and $R_5$ represents a dibasic aliphatic ester group, $R_8$ normally comprises from 2 to 10 linear carbon atoms, that is to include succinate, glutarate, adipate, suberate, azelate and dodecanedioate, in respect of unbranched diradicals and trimethyladipate in respect of branched diradicals. Alkyl substituents of $R_8$, if present, are often $C_1$ to $C_4$. It is particularly desirable for the ester grouping in such di-functional esters that is distant from the gem ester to form part of an enol ester linkage, particularly with a phenyl group. Alternatively, it is possible for that distant group not to be esterified, allowing it to remain as a free carboxylic acid. Advantageously, many of the aforementioned peracid generators are liquid at or near ambient temperature which means, for example, they can be readily dispersed in aqueous media during use in for example sanitising or washing or bleaching, thereby minimising the possibility of localised concentrations of peracid, and also avoiding the problems of irritancy and the like caused by powders in which it is necessary to employ solid peroxygen generators.

It will further be understood that where the gem-diester product is derived from an alpha-omega dialdehyde, one method of pre-production of the dialdehyde can obtain some material terminating at one end of the molecule in a vinyl ether group and at the other end in an aldehyde group. For the avoidance of doubt, the vinyl ether and gem-diester-containing product obtainable from such a process is contemplated within the scope of the instant invention.

It will be recognised that hitherto there have been various compounds proposed which are liquid at ambient temperatures and which can act as peroxyacid generators. An example of such a compound is vinyl acetate. Unfortunately, although vinyl acetate has various commendable features, its availability for widespread use is hampered by its rather low flash point as is in consequence the flashpoint of liquid compositions containing a substantial proportion of it. Advantageously, by comparison with such compounds, the peroxyacid generators according to the instant invention have a substantially comparable activity with respect to peroxyacid generation, but a substantially higher flashpoint. This means that the invention compounds and liquid compositions containing a substantial proportion of them are correspondingly safer to store and transport. Moreover, the instant invention compounds also retain the advantage of ready biodegradability, low toxicity and freedom from nitrogen and phosphorus.

The esters according to the recent invention can be made by one or other of the following general routes described herein, the selected method depending upon the functionality of the component moieties. The first method can readily be applied to the manufacture of gem-diesters having the formula

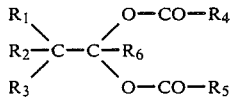

in which $R_1$, $R_2$ and $R_3$ are all monofunctional and at least one of which represents hydrogen and in practice preferably all three, $R_6$ represents hydrogen or alkyl and $R_4$ and/or $R_5$ represent mono or difunctional moieties. Expressed at its broadest, method 1 comprises reacting an enol ester having the formula

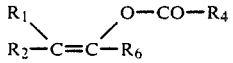

with a carboxylic acid having the formula $R_5—CO_2H$ in the presence of an acid catalyst. It will further be recognised that compounds terminating at each end with an enol ester or with a carboxylic acid group can be substituted for the monofunctional compounds described herein above, and the mole ratios of the reactants adjusted correspondingly.

In the presence of a strong acid such as a strong organic acid, that is soluble in the reaction medium, such as methane sulphonic acid or paratoluene sulphonic acid, and/or a strong inorganic acid such as sulphuric acid or perchloric acid, the reaction is carried out at a temperature desirably of at least 40° C. and preferably at least 60° C. and conveniently at up to 100° C. For reaction mixtures having a boiling point of below 100° C. it is often most convenient to employ a temperature at or within 5° C. of the reflux temperature.

In the case of vinyl acetate as the liquid starting material, the mixture refluxes at around 80° C., but naturally, for other enol esters, the reflux temperature will be different. A temperature in excess of 100° C. can be used for some enol esters, with an increasing risk of polymerisation. Reaction is normally carried out for several hours until a substantial proportion of the enol ester has been converted to form a gem diester, or a mixture of diesters in some cases, which can be determined for example by periodically measuring the residual concentration of carboxylic acid in a sample. It is usual for a reaction period of at least 1½ and often at least 3 hours, typically up to 12 hours and often from 4 to 8 hours to be employed.

The sulphonic acid catalyst is normally separated out, subsequently, in practice though not essentially after the reaction mixture has cooled to at or near ambient temperature, the separation is effected by washing the reaction mixture with water and/or a mildly alkaline aqueous solution, for example of sodium acetate or sodium bicarbonate and the aqueous and organic phases separated.

Further purification of the reaction mixture is desirable, and can be effected either by distilling under a reduced pressure at 40 to 2500 Pa, and/or by stripping off any low boiling starting material or impurities.

A related alternative route employs the same starting materials but either a mercury II acetate or palladium II system which include or generate acid as catalyst. In such a route the reaction temperature is normally greater than ambient, but below reflux temp and particularly from 40° to 70° C., for a period usually in excess of 3 hours, especially from 5 to 8 hours. Subsequently, and especially after the reaction mixture has cooled to approximately ambient temperature, the catalyst can be removed by washing with an aqueous solution of a metal-ion sequestrant, typically ethylene diamine tetraacetic acid or related amino compounds. Thereafter, separation and purification of the reaction mixture can follow the preceding route.

It will be recognised that this technique is especially well adapted to the production of peracid generators in which the ester groups are different. Such compounds can have particular advantages, and for example ethylidene benzoate acetate, which can readily be obtained by reactions between benzoic acid and vinyl acetate has a remarkably low smell, thereby rendering it more acceptable to both domestic and commercial users who can often be substantially off-put especially by acetic acid developed on storage by and from enol esters.

In a second general method, compounds can be obtained having the general formula

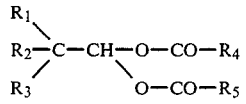

and the corresponding compound terminating at one end in an enol ester and the other in gem diesters or at both ends in gem diesters. In this process, an aldehyde of formula:

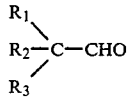

or corresponding dialdehyde preferably after dewatering, is reacted with an anhydride of formula $R_4—CO—O—CO—R_4$ or $R_4—CO—O—CO—R_5$ or with a mixture of the two anhydrides $R_4COOCOR_4$ and $R_5COOCOR_5$ in the presence of an alkali or soluble alkaline earth metal carboxylate, especially an acetate, at a temperature in excess of 80° C. and preferably in excess of 100° C. and conveniently at or near the reflux temperature of the reaction mixture. The mixture can be monitored for example by intermittent sampling, and halted when a desired amount of gem-diester has formed. The reaction period is normally at least 3 hours and in many instances is from 4 to 6 hours, although at temperatures in the vicinity of 100° C. somewhat longer periods are preferable.

After the reaction is halted, the mixture is preferably water washed at below 100° C. to remove the water-soluble carboxylate, and is preferably dried such as by addition of acetic anhydride. A purer product can subsequently be obtained by stripping out unreacted aldehyde and carboxylic acid and further by fractional distillation.

In practice, there is often obtained a mixture of products including that in which the gem-diester has been formed at each of the dialdehyde groups and one in which a gem-diester has been formed from one of the aldehyde groups and an enol ester at the other aldehyde.

The second essential component for carrying out a peracid generating process according to the present invention is hydrogen peroxide or a compound which can produce hydrogen peroxide in use. Such compounds include adducts of hydrogen peroxide with various inorganic or organic compounds, of which the most widely employed adduct is sodium carbonate perhydrate, which is often referred to as sodium percarbonate. Other adducts include sodium phosphate perhydrate, a persalt obtained by addition of hydrogen peroxide to mixed sodium sulphate and sodium chloride or sodium sulphate with potassium chloride, adducts of hydrogen peroxide with zeolites, or urea hydrogen peroxide. Other hydrogen peroxide-developing compounds which are of a special importance comprise sodium perborate, often in the form of either the tetrahydrate or the monohydrate but also usable as the trihydrate. These compounds can either by introduced as such or in admixture with other components such as surfactants, sequestrants, builders, pH regulators, buffers, stabilisers, processing additives or any other known components of washing compositions, sanitising compositions, disinfecting compositions or bleach additives.

In order to avoid premature interaction of the hydrogen peroxide or persalt with the peroxyacid generator, the two components can be introduced separately into the point of use, but can alternatively be adsorbed into a substrate or incorporated into liquid formulations.

Liquid formulations demonstrating markedly enhanced storage stability in comparison with related formulations containing the specified diesters of subclass (e) in GB No. A-836988 can be obtained by incorporating the invention gem diester peroxyacid generator in an acidic aqueous emulsion together with an emulsifying amount of an emulsifier, preferably a reasonably matched emulsifier. By the term 'matching' is meant that the emulsifier or combination of emulsifiers having an HLB value substantially the same as that of the activator. The more closely the HLB values of emulsifier and peroxyacid generator match, the greater the tendency for the liquid system to be capable of containing in microemulsion form a comparatively high concentration of generator. However, and by way of corollary, as the ratio of emulsifier to generator increases, the extent of matching of HLB values can be relaxed, as will be apparent later herein.

In emulsions described herein, the concentration of hydrogen peroxide is normally at least 1%, desirably at least 3% and conveniently is not more than 20% and quite often not more than 10%, all by weight of the composition. In many of the instant compositions, hydrogen peroxide concentration is in the range of 4 to 8% by weight of the composition. The balance of the aqueous phase comprises water which in practice is often in the region of 30 to 85% of the composition weight. It is preferable to select compositions in which the concentration of hydrogen peroxide in the aqueous phase is less than 35% w/w in the phase and often is 10 to 35% w/w on that basis and it will be recognised that such concentrations correspond often to overall peroxide concentrations of below 10% w/w on the composition.

The aqueous phase also contains sufficient water soluble-acid to generate an acidic pH, preferably from pH2 to pH5, and especially pH2 to pH3.5. Such a pH may often be obtained in the aqueous phase of the emulsion in practice by dilution with demineralised water of commercially available hydrogen peroxide solutions which contain a small amount of acidic stabilisers such as pyrophosphoric acid and/or one or more phosphonic acids (particularly amino methylene phosphonic acids, such as DTPMP and EDTMP, and often on emulsification a small proportion of organic acid from the activator can transfer into the aqueous phase. The pH of the composition can readily be monitored and if necessary adjusted to the preferred range by suitable acid or base introduction. The aqueous phase can additionally contain a small amount of a thickener, such as about 0.5% by weight of the composition of a xanthan gum, the precise amount being variable at the discretion of the manufacturer to obtain a desired viscosity.

The concentration of activator in the composition is normally selected in the range of from 1 to 35% by weight, is usually at least 3% by weight and in many embodiments is from 10 to 30% by weight. Many useful compositions contain activator in the range 3 to 10% w/w. Of course, it will be recognised that the higher molecular weight activators tend to be present in somewhat higher concentrations than the lower molecular weight activators, in order to achieve a similar mole ratio to the hydrogen peroxide. Thus, in some embodiments for activators having an equivalent molecular weight of up to 100 the proportion of activator is preferably from 10 to 20% by weight, for activators having an equivalent molecular weight of over 100 to 130 the corresponding proportion is preferably from 15 to 25% and for activators having a molecular weight of over 130, the corresponding proportion is preferably from 20 to 30% by weight.

The amount of emulsifier that can been used can be found over a very wide range. One convenient way of assessing how much emulsifier to employ is to relate it to the weight of activator present. Naturally one should also take into account the extent to which the activator and emulsifier are matched in the formulation employing low relative amounts of emulsifier only when they are reasonably matched. With that proviso, the amount of emulsifier usually employed is at least 5% by weight based on the activator, and indeed in many desirable compositions is from 10% likewise based with a reasonably matched emulsifier/activator system, and it is possible to achieve excellent emulsions, using less than 100% emulsifier w/w based on the activator, though when around 50% or less emulsifier is employed there is a marked tendency for it to be a macro-emulsion. Particularly in the region of at least 70% emulsifier in such a matched system, it tends to form a micro-emulsion. Naturally, above 100% emulsifier can be used if desired, but for a matched system, its justification would often be found in some non-emulsion aspects of the inventions, for example in order to improve washing performance; however in a system that is less well matched, it can be beneficial for the emulsion stabilitity to employ over 100% w/w emulsifier. Normally, the total weight proportion of emulsifiers in the emulsion is not more than 60% w/w.

The extent to which the matching of HLB values for the activator/emulsifier can be related in the context of the present disclosure using high amounts of emulsifier can be gauged from the fact that clear emulsions can be formed from water soluble anionic emulsifiers such as alkyl benzene sulphonate, alcohol sulphates or sulphosuccinates provided that the weight ratio of the emulsifier to activator is generally at least 4:1 and in some instances from 2:1 to 4:1 also, in the range of activator concentrations from 1–10% w/w. At ratio of emulsifier to activator below those ranges but at least 1:1, the emulsion is primarily a macroemulsion, but it will be seen to comprise two phases only, i.e. does not separate readily to a three phase system.

A list of suitable emulsifiers is given in European Patent Specification No. 92932A, on pages 10 and 11 which is incorporated herein by reference. It will be recognised that there are other and closely related emulsifiers to one or more of the listed emulsifiers which will have similar characteristics or characteristics having a predictable difference. For example, the PEG 400 monostearate has an HLB value approximately 1.4 units lower than the PEG 400 monolaurate emulsifier listed and the POE(20) cetyl alcohol (ether) has an HLB value 2.8 higher than the corresponding POE(10) cetyl alcohol (ether). It is often desirable to match unsaturated emulsifiers with unsaturated activators and vice versa.

In addition, mixtures of the emulsifiers, such as a mixture of one or more alkyl benzene sulphonates and/or alcohol sulphates and/or sulphosuccinates with one or more water-soluble alkyl phenol and/or ethoxylated fatty alcohol or acid, alkanolamine or other ethoxylated nonionic emulsifier, can be used. The ratios of the mixtures can be selected within wide limits, with the ratio of anionic to nonionic emulsifier usually in the range 10:1 to 1:10. In the preferred range of 3:1 to 1:3 and by so doing it is often possible to extend the area within which the compositions are clear rather than being strictly macroemulsions. In many instances such co-operation between the two types of emulsifiers could enable clear compositions to be formed containing 1 part activator per 2 to 3 parts by weight of the emulsifier system. An excellent example comprises a 2:1 to 1:2 ratio of a nonylphenol ethoxylate with a sulphosuccinate.

Some, or the major part or all of the emulsifiers is often premixed with the activator before subsequent dispersion in the aqueous hydrogen peroxide, such amount in many cases comprising 100% to 50% of the weight of the activator. However, it is possible for some of the emulsifier combination to be pre or post mixed in the aqueous phase, especially in respect of an anionic emulsifier, in which case for example up to 50% and typically at least 5% of such emulsifiers by weight based on the activator can be so added to the aqueous phase. Advantageously, it has been found in some embodiments that transparent emulsions can be obtained, such as by including an anionic emulsifier as well as a nonionic emulsifier and employing at least about half as much emulsifier as activator. All or part of the anionic emulsifier can in the main be added in either phase at the discretion of the formulator.

It is possible also to employ an intermediate weight aliphatic alcohol having a $C_5$ to $C_8$ chain length to co-operate with especially the anionic emulsifiers, in a weight ratio thereto often of up to 2:1.

In addition to the foregoing components, the composition can also contain one or more dyes or perfumes, preferably those which have demonstrable resistance to attack by peroxygen compounds, usually in an amount of less than 0.5% by weight. Since the composition may be used for the bleaching of absorbent materials, it may also be advantageous to add an optical brightening agent to the formulation. This would usually be employed in an amount not greater than 2% by weight, often from 0.5 to 1%, and should also be resistant to attack by peroxygen compounds.

It will be recognised that when high ratios of emulsifier to activator are used, it is possible to obtain bleach activator compositions which establish their own balance of nonionic to anionic surfactants when used in conjunction with conventional amounts of a base washing composition and therefore can minimise the risk of impaired cleansing of surfactant-sensitive soils which can occur if relatively low ratios of emulsifier to activator are employed.

It will be recognised, furthermore, that an alternative approach is facilitated by the use of the type of compositions described herein. In this latter approach, the bleach activator composition can be tailored for use in conjunction with a selected washing composition so that the benefits of the bleach augment the performance of that washing composition without interfering markedly with the cleansing of surfactant-sensitive stains. This can be achieved by matching the emulsifier system of the bleach composition to the surfactant mixture in the washing composition and then employing a high concentration of the emulsifier system into which is introduced the selected activator in a relatively low ratio thereto.

Normally, the aqueous phase comprises at least 25% and the organic phase not more than 75% of the emulsion. In many emulsions described herein, the aqueous hydrogen peroxide comprises from 40 to 95% by weight of the composition and correspondingly the organic phase, mainly the activator and emulsifier comprises the balance of from 60 to 5% by weight The compositions can conveniently be plotted as weight percentages using triangular coordinate graph paper for respectively aqueous hydrogen peroxide, activator and emulsifier(s). Certain preferred compositions are in the quadrilateral defined by the coordinates 90,3,7; 50,35,15; 25,15,60; 37,3,60. Many such preferred emulsions, can be defined by the quadrilateral with coodinates 65,10,25; 45,30,25; 25,15,60; 30,10,60. These are illustrated in FIG. 1 which is a three component diagram on triangular coordinate graph paper.

The aqueous emulsions of the instant invention can be prepared using activator, emulsifier, hydrogen peroxide and water in the proportions described hereinbefore, in a series of steps comprising:

1. forming an organic phase by mixing together at a temperature of up to 70° C. the activator with at least the major weight part of the emulsifier or emulsifiers, thereby intimately contacting both components together;

2. separately preparing an aqueous solution of hydrogen peroxide and the balance, if any, of emulsifier, especially if the latter is anionic, at a concentration of hydrogen peroxide sufficient to provide the desired amount thereof in the emulsion said concentration often being selected in the range 5 to 25% by weight of the aqueous phase, usually at a temperature of below 50° C., and preferably from 10° to 25° C.;

3. introducing the aqueous hydrogen peroxide solution into the organic phase comprising emulsifier and activator, in the appropriate weight ratio and subsequently or simultaneously subjecting the resultant mixture to a shearing force sufficient to disperse the organic phase, preferably at the natural temperature obtained by mixture of the two phases.

In an alternative liquid formulation that demonstrates particularly good storage stability, as shown for example, by the retention of activator therein, the activator and an aqueous hydrogen peroxide solution are both dissolved in an organic solvent that is miscible with both aqueous and hydrophobic liquids. Such liquids are normally oligomers of short chain glycols or partial short chain aliphatic ether or ester derivative of them or glycols or glycerol. The molecular weight of such solvents is normally in the range of 125 to about 450. Unsubstituted glycol oligomers, especially of ethylene or propylene glycols comprise not more than respectively 10 or 7 units and for ether or ester derivatives from 2 to 5 units. The short chain ester or ether is normally $C_1$ to $C_4$. Examples include polyethylene glycol having an average molecular weight of from 200–400, di- or tripropylene glycol, and the mono-acetate or mono-propionate derivatives or the monopropyl or monobutyl ether of ethylene glycol, propylene glycol or diethylene glycol. Mixtures of two or more of these solvents can be employed in any weight proportion to each other. The solvent can also contain, if desired, one or more of the anionic and/or nonionic surfactants to which reference will be made subsequently in conjunction with washing compositions, including in particular linear alkyl benzene sulphonate salts, in a weight ratio to the solvent of up to 2:1 and often up to 3:2. For convenience these compositions are referred to as solutions, through their precise structure is not known.

These solutions conveniently comprise at least 55% w/w of the solvent and any anionic or nonionic surfactant, and normally up to 35% activator and normally up to 40% aqueous hydrogen peroxide. It will be recognised that in practice that there are also two further constraints, namely first that it is desirable to maintain an equivalent mole ratio of hydrogen peroxide to activator of at least 1:1 and preferably 1.5:1 to 2.5:1 so that most effective use is made of the activator when the composition is subsequently employed to generate peroxyacid species. The second practical constraint is that it is preferable to avoid the more concentrated hydrogen peroxide solutions which might lead to irritation or skin oxidation should the solution, undiluted, come into contact with the user. Thus as the proportion of aqueous component increases, it is possible to achieve the same equivalent mole ratio of hydrogen peroxide to activator whilst employing less concentrated hydrogen peroxide. Thus, in practice, it is usual for these solutions to contain at least 10% w/w aqueous hydrogen peroxide, and usually up to 30% w/w. Simultaneously, in practice, it is normally more convenient to include at least 10% w/w activator and likewise normally not more than 30% w/w, even though of course a lower activator concentration of say 3 to 10% or even 1–3% is possible without difficulty if the lower concentration of activator can be tolerated. The preferred compositions are defined by the pentagonal area bounded by the coordinates (aqueous $H_2O_2$, activator, solvent/surfactant), 30,15,55; 15,30,55; 10,30,60; 10,10,80; 30,10,60. Especially preferred compositions are defined by 30,15,55; 20,25,55; 10,20,70; 10,10,80: 30,10,60. These are illustrated in FIG. 2 which is a three component diagram on triangular coordinate graph paper.

Whilst the foregoing compositions are primarily intended for use in conjunction with some other composition such as a detergent composition, one further category of composition merits close attention. In this category, the peroxygen compound is provided in the form of a persalt instead of hydrogen peroxide and it is suspended in particulate form in an anhydrous solution of the aforementioned activators. Optionally, the compositions can contain one or more suspended particulate detergent builders.

The liquid component usually contains at least one surfactant which, if it is liquid at storage and use temperatures, i.e. desirably melts at no higher than 10° C. and preferably below 0° C., such as many nonionic surfactants, can comprise if desired the entire component A. However, in practice it is highly convenient to employ together with the surfactant a non-aqueous water-soluble or water dispersible organic solvent. By so doing it is not only possible to employ normally solid and readily available surfactants but also adjust the viscosity and appearance of the liquid component for ease of pouring of the composition and control of the physical stability of the suspension of any particulate component. The weight ratio of surfactant to solvent often is selected in the range of 100:0 to 5:95, and in many practical embodiments is within the range of 60:40 to 10:90.

The surfactants which can be employed herein can be non-ionic, anionic, cationic, or amphoteric. Generally, the surfactants contain at least one hydrophobic group, e.g. an aliphatic hydrocarbon group containing at least 8 carbon atoms, and often from 10 to 26 carbon atoms, the aliphatic group often being acyclic, but sometimes containing an alicyclic group, or the hydrophobic group can be an alkaryl group containing at least 6 and preferably up to 18 aliphatic carbon atoms. The surfactant contains in addition at least one water-solublising group for example a sulphonate, sulphate, or carboxylic group which is linked either directly or indirectly to the hydrophobic group. Linking members can include residues of polyhydric alcohols containing etheric or esteric linkages, for example derived from ethylene glycol, propylene glycol, glycerine or polyether residues. The surfactants can be soaps or be synthetic, for example as described in chapter 2 of Synthetic Detergents by A. Davidsohn and B. M. Milwidsky, 5th Edition published in 1972 by Leonard Hill, London, and methods of making them are described in chapter 4 of the same book.

Amongst anionic surfactants described on pages 15–23 of the aforementioned book, sulphonates and sulphates are of special practical importance. The sulphonates include, for example, alkaryl sulphonates, and particularly alkyl benzene sulphonates, the alkyl group preferably being straight chain containing 9 to 15 carbon atoms, of which one of the most commonly employed surfactants is linear dodecyl benzene sulphonate. Other anionic sulphonates which are useful in washing compositions herein include olefin sulphonates, obtained, for example, by sulphonating primary or secondary aliphatic mono-olefins, alkane sulphonates, especially linear alkane sulphonates, and hydroxy alkane sulphonates and disulphonates, especially 3-,4-, and 5-,hydroxy-n-alkyl sulphonates in which the alkyl group contains any even number from 10 to 24 carbon atoms. Other desirable anionic surfactants include $C_8$–$C_{22}$ fatty acid soaps, alcohol sulphates, preferably linear, having a chain length of at least 10 carbon atoms and sulphated fatty acid alkanolamides. Other sulphates comprise sulphated nonionic surfactants as for example alkylphenoxy-ethylene oxide ether sulphate in which the alkyl groups contain from about 8 to 12 carbon atoms and there are 1 to 10 units of ethylene oxide in each molecule. Yet other sulphate surfactants comprise alkyl ether sulphates where the alkyl group contains from 10 to 20 carbon atoms, preferably linearly and each molecule contains from 1 to 10 preferably from 1 to 4 molecules or ethylene oxide. Further anionic surfactants include phosphate derivatives of the ethylene oxide based nonionic surfactants described herein.

It is of considerable advantage that at least a proportion of the anionic surfactant be in liquid form or readily liquifyable.

In an especially suitable class of anionic surfactants the counter ion is a quaternary ammonium cation derived for example from ethanolamine or isopropylamine.

A considerable proportion of nonionic surfactants suitable for use in the present invention comprises condensation products of ethylene oxide and possibly propylene oxide. One class of such nonionic surfactants which is of special importance comprises water soluble condensation products of alcohols containing from 8 to 18 carbon atoms with an ethylene oxide or polymer thereof often providing or containing at least 5 molecules of ethylene oxide per molecule of surfactant, e.g. from 7 to 20 moles of ethylene oxide. Particularly desirable nonionic surfactants comprise water soluble condensates of alkyl phenols or alkyl naphthols with an ethylene oxide polymer thereof normally providing or containing from 5 to 25 moles of ethylene oxide per mole of alkyl phenol or alkyl naphthol. The alkyl group normally contains from 6 to 12 carbon atoms and is frequently linear.

As an alternative to the hydrophobic moiety of the nonionic surfactant being linked to the hydrophilic moiety by an ether link as in alkyl phenol/ethylene oxide condensates, the linkage can be an ester group. The hydrophobic moiety is normally the residue of a straight chain aliphatic acid containing from 8 to 22 carbon atoms and more particularly lauric, stearic and oleic residues. In one class of nonionic ester surfactants, the hydrophilic moiety often comprises polyethylene oxide, frequently in the ratio of from 5 to 30 moles of ethylene oxide per mole of the fatty acid residue. It will be recognised that both mono and di esters can be employed. Alternatively it is possible to employ as the hydrophilic moiety glycerol, thereby producing either mono or di glycerides. In a further group, the hydrophilic moiety comprises sorbitol. A further class of nonionic surfactants comprise alkanolamides in which a C10 to C22 amide is condensed with a polyethylene oxide or polypropylene glycol hydrophilic moiety or moieties. Semi-polar detergents include water soluble amine oxides, water soluble phosphine oxides and water soluble sulphur oxides, each containing one alkyl moiety of from 10 to 22 carbon atoms and two short chain moieties selected from the groups of alkyl and hydroxyalkyl groups containing 1 to 3 carbon atoms.

The anionic and nonionic surfactants are often employed together in many cases in a weight ratio within the range 2:1 to 1:10. In built compositions the ratio is often from 2:1 to 1:3 whereas in unbuilt compositions the ratio is often from 1:2 to 1:6.

The aforementioned are the anionic and nonionic surfactants which can be incorporated in the aqueous hydrogen peroxide/activator/glycol and the like solvent compositions referred to hereinbefore.

In practice, cationic detergents are normally not present in the same composition as anionic surfactants, but when cationic detergents are used they are frequently quaternary ammonium salts such as tetraalkyl ammonium halides in which at least one of the alkyl group contains at least 10 carbon atoms or quaternary pyridinium salts substituted by an alkyl chain of at least 10 carbon atoms.

Useful amphoteric surfactants include derivatives of aliphatic quaternary ammonium, sulphonium and phosphonium compounds in which the aliphatic moieties can be linear or branched, or two of which can join to form a cyclic compound, provided that at least one of the constituents comprises or contains a hydrophobic group containing from about 8 to 22 carbon atoms and the compound also contains an anionic water solubilising group, often selected from carboxylic, sulphate and sulphonates.

The non-aqueous organic solvents which can be employed in these suspended persalt compositions are liquid alcohols, poly-ols, amines, low molecular weight ether or ester derivatives of alcohols or polyols, or liquid polyglycols or a combination of any two which form a liquid with the surfactant, i.e. include many already referred to in the context of the aqueous hydrogen peroxide/activator solutions.

Usable alcohols include $C_2$ to $C_6$ linear or where structually permissible branched alcohols including ethanol, propanol, isopropanol, butanol and hexanol. Polyols can be diols, as in ethylene glycol, propylene glycol or polymers thereof in a molecular weight for polyoxyethylene glycol especially of up to 500 and for polyoxypropylene glycol of up to 4000. Alternatively the polyol can be trihydric such as glycerol. Typically the polyol monomer contains up to 6 carbon atoms.

Usable low molecular weight ether derivatives include $C_1$ to $C_4$ alkyl (linear or branched) ethers derived from the aforementioned alcohols/polyols and in many instances the derivatives of a glycol or a di- or tri- glycol, such as monoethyl ethers of ethylene glycol or triethylene glycol, or tripropylene glycol, the monopropyl or monobutyl ether of ethylene glycol or diethylene glycol and the monobutyl ether of dibutylene glycol.

Suitable esters include mono, di and tri acetates of glycerol, digol monoacetate, dipropylene glycol mono or diacetate and ethylene glycol acetates.

Alternatively, low molecular weight amines such as $C_4$ to $C_6$ amines, including linear and isobutylamine and cyclohexylamine can be employed, or di or trialkyl amines such as diethylamine, or trimethylamine, although at least some are malodorous or have a low flash point. A useful class comprises alcohol amines, often containing up to 6 carbon atoms, and in many cases derived from ethanol or isopropanol or ethylene or propylene glycol. Examples include mono, di or triethanolamine, or the corresponding isopropanolamines and diglycolamine and morpholine. A further useful class of solvents comprises the ether or ester derivatives and N-alkyl or N-acyl derivatives of the aforementioned alkalolamines. The alkyl/acyl group often comtains 1 to 4 carbon atoms. Examples include N-acetyl ethanolamine.

The persalt is selected from especially alkali metal (normally sodium) perborates, percarbonate, perphosphates and also organic adducts such as urea hydrogen peroxide. Amongst other compounds there also come into consideration the $H_2O_2$ adducts of mixed $NaCl/K_2SO_4$ and $KCl/K_2SO_4$, i.e. clathrate compounds and the adducts of $H_2O_2$ with various zeolites. A commonly selected persalt is either sodium perborate tetrahydrate or sodium percarbonate, but much more advantageously is sodium perborate monohydrate, which can function as an in situ water absorbent. Thus, the most preferred persalt is sodium perborate monohydrate, especially when overdried.

Since the persalt is included as a hydrogen peroxide generator, it is preferably employed in the equivalent mole ratio to the activator described hereinbefore for hydrogen peroxide itself.

It will be understood that good washing performance can be achieved in the absence of a detergent builder, and such compounds tend to exhibit higher avox stability. However, in order to enhance detergency it is advantageous though not essential to include at least one detergent builder and when such is desired, it is preferably incorporated as a dispersible particulate solid. Both water soluble or water-insoluble builders can be used. Water soluble builders of especial value include alkali metal polyphosphates, pyrophosphates and polymetaphosphates, and in particular the sodium and/or potassium salts, and additionally, the sodium/hydrogen or potassium/hydrogen salts can be used. Other soluble builders include alkali metal borates, silicates and carbonates, again especially the sodium salt. Amongst water-insoluble builders, noteworthy examples are zeolites that obey the formula $(M_2O)_x(Al_2O_3)(SiO_3)_y$, in which M is a monovalent metal, x is 0.7 to 1.5 and y is from 1.3 to 4.0 of which especial value accrues to sodium X, sodium A and mixtures thereof. To achieve a lower wash pH, boric acids may be used.

To some extent, at least a proportion of the builders can comprise organic sequestrant-type builders of which suitable classes include aminocarboxylic acids, aminophosphonic acids, polycarboxylic acids and polyhydroxycarboxylic acids, either employed as such in order to promote a somewhat lower washing pH or in salt form. Examples of note include nitrilotriacetic acid, (NTA) ethylene diaminotetraacetic acid or the corresponding methylenephosphonic acids, citric acid, gluconic acid, $C_2$ to $C_{10}$ dicarboxylic acids 1,1,3,3-propanetetracarboxylic acid, oxydiacetic acid, oxydisuccinic acid, furan tetracarboxylic acid and tetrahydrofuran tetracarboxylic acid, as such or as their sodium or potassium salt.

The ratio of acidic to salt builders and the total amount of the builders is often so arranged as to generate an alkaline pH, the particular from pH 7.5 to 10.5 in the wash water. When a preformed peroxyacid is used the pH is preferably 7.5 to 8.5 and when a persalt/activator of pH 8.5 to 10 is preferable to promote perhydrolysis.

In practice, it is often convenient for the organic builder to comprise only a small proportion of component (C) such as from 0 to 20%, although much higher proportions can be tolerated especially where sodium citrate or NTA are employed to replace phosphate builders.

In addition, the compositions herein can contain at least one detergent auxiliary agents which comprise soil antiredeposition agents, dye transfer inhibitors, optical brightening agents, peroxy stabilisiers, corrosion inhibitors, bactericides, foam enhancers, foam inhibitors, thickeners, absorbents, abrasives, diluents, dyes, perfumes and proteolytic enzymes. Amongst the auxiliary agents, carboxymethyl cellulose salts and polyvinylpyrrolidines deserve mention as SARDs, the various aminocarboxylates, aminomethylenephosphonates, hydroxy quinolines and dipicolinic acid as peroxy stabilisers and/or dye transfer inhibitors, silicates for corrosion inhibition, quaternary ammonium or pyridinium halides as bactericides, alkanolamides and ethylene oxide/propylene.oxide copolymers to regulate foaming. Derivatives of diaminostilbene sulphonic acid, diarylpyrazolines and aminocoumarins are examples of OBA's, anhydrous sodium or magnesium sulphate are examples of absorbents and diluents, silica or maleic modified cellulose, polyethylene oxide e.g. above MW of 10,000, maleic anhydride copolymers with ethylene, styrene or methylvinyl ether, especially above 50,000 MW, or polyvinyl pyrrolidine as a thickener, and silica or kieselguhr as abrasives. Naturally, it is preferred to select dyes and perfumes known not to interact readily with peroxygen compounds, and to coat any enzyme with water sluble/dispersible coating for storage protection.

Solids which are to be incorporated in the compositions herein are preferably finely ground so as to reduce the likelihood of settling out, for example having a mean particle diameter of below 0.1 mm, and often between 0.01 mm and 0.1 mm.

A wide latitude is permitted in the ratio of the components, but the total solids content preferably comprises no more than about 50% w/w, and is commonly in the range 5% to 45% w/w. Conversely the liquid components normally comprise at least 50% and often 55 to 95% w/w.

In many embodiments, the detergent auxiliary agents comprise up to 10 parts by weight except when it contains diluent or abrasive when it may provide up to 40 parts by weight.

The persalt comprises often 5 to 20 parts by weight, the activator 5 to 30 parts by weight, and the builder from 0 to 30 parts by weight based on a composition of 100 parts by weight.

The suspended persalt compositions can readily be made by blending the components together in the appropriate ratios. Preferably, the surfactants are blended together at ambient to 60° C. alone or with the solvent, the activator (if any) is introduced and then finally the solids are stirred in until the mixture is homogenous.

The manufacture of the hydrogen peroxide solutions or persalt suspensions can be carried out using the apparatus described for making the liquid emulsions.

Alternatively, for incorporation in solid washing compositions containing one or more of the aforementioned washing components or additional components of such compositions, the gem diester activators can be incorporated into or onto a suitable substrate of which for reasons of practicability, the most suitable located to date is sodium perborate monohydrate, which is the subject of a co-pending application.

In the process of the present invention, the hydrogen peroxide or hydrogen peroxide-developing compound is preferably employed in an equivalent mole ratio to the peroxyacid generator of from 5:1 to 1:5 and especially from 2:1 to 1:2. For the avoidance of doubt, the equivalent number of moles is the actual number of moles multiplied by the number of active sites per molecule.

As referred to hereinbefore, in washing processes the hydrogen peroxide and peroxyacid generator can be employed in conjunction with a washing composition. In the event that the hydrogen peroxide and/or developer is added separately from the peroxyacid generator it is most convenient for one or other component to be incorporated in the washing composition, for example an aforementioned persalt in a particulate washing composition, typically in an amount of from 5 to 40% by weight thereof. Where the two components are preformed into a composition such as an acidic aqueous emulsion, there is no need for the washing composition to contain a persalt, but persalt-containing compositions can still be used with such emulsions with equal facility. Such a washing composition would normally contain from 5–95% and often from 5–40% of a surface active agent or combination of agents selected from anionic, nonionic, cationic and ampholytic, and zwitterionic surfactants and normally from 1–90% of one or more detergent builders, frequently from 5–70% and often up to 50% by weight of diluents or processing additives, and finally up to 20% by weight of auxiliary agents. These components have already been described in conjunction with suspended persalt compositions, and the description given therein in respect of them applies here also, with the proviso that for solid washing compositions, the surfactants chosen are solid at up to 40° C., at least, and thus the appropriately higher molecular weight homologues of the mainly liquid surfactants are selected from the classes described.

Phosphonic acid chelating builders include especially hydroxyalkyl- 1,1 - diphosphonic acid, ethylenediaminotetramethylene tetraphosphonic acid and diethylenetriaminopentamethylene pentaphosphonic acid, and salts thereof, and can be present in, e.g. 1-5% w/w to provide stabilisation of the persalt.

The builder in conjunction with the surfactant, often produces a washing solution that has a pH of at least pH7 and often pH8-10.5.

Washing, disinfecting or bleaching processes according to the present invention can be carried out at any temperature up to the boiling point of the aqueous solution of the hydrogen peroxide/peroxyacid generator, but preferably from ambient to 60° C. In general it is desirable to employ sufficient of the hydrogen peroxide/peroxyacid generator to yield at least one part of available oxygen (avox) per million parts by weight of solution and preferably at least five parts per million. For household washing solutions, obtained by dissolution of a detergent composition either containing or into which is introduced the hydrogen peroxide/peroxyacid generator, the concentration of avox is frequently from 5-100 parts Avox per million parts of solution by weight, but more concentrated solutions can be employed if desired.

The period of contact between an aqueous washing solution containing the hydrogen peroxide/peroxyacid generator with the fabric, clothes or other articles to be washed is often at least 5 minutes and generally each wash is between 10 minutes and an hour. However for cold soaking or steeping, longer periods such as steeping overnight can be employed also. The aforementioned solutions can be employed also to wash and disinfect hard surfaces of which typical examples are metal, plastic, wood, ceramic, glass or paint-coated surfaces. The invention process composition can be employed in the rinse stages of a machine wash cycle, especially in the first rinse. In practice, though, it is usual for the washing composition to be employed at a concentration of from 0.5 gpl to 20 gpl and often from 0.8 gpl to 10 gpl, washing practices such as washload to liquor ratios varying from country to country. When the hydrogen peroxide/peroxyacid generator composition is used as an additive in conjunction with the washing composition or introduced separately into for example a subsequent rinsing stage, it is often employed at a concentration of from 0.3 to 4 gpl and in many instances from 0.5 to 2.5 gpl. Use outside these ranges is, of course, at the discretion of the user. As an alternative, a slurry or paste of the composition containing the hydrogen peroxide/peroxyacid generator and a surfactant composition and having a much higher avox content thereby, such as from 200-500 ppm avox may be employed instead. Furthermore, the solutions obtained by dissolution of the compositions or the hydrogen peroxide and peroxyacid generator separately, hereinbefore described to yield the appropriate concentration of avox can be used to bleach textile fabrics, wood or pulp under the conditions and employing the equipment used for bleaching such articles with alkaline hydrogen peroxide.

In such processes for the disinfection/sanitising of aqueous media, such as recirculating water systems, such as in industrial cooling circuits, or effluents from food-processing industries, paper mills, sewage stations, or in potable or industrial water supplies, optionally chlorinated, the disinfection process can conveniently be effected by introducing the hydrogen peroxide/peroxyacid generator together with any pH regulator or buffer as desired into the aqueous media particularly to employ a pH generally in the region of from 5 to 9, and in general, sufficient of the salt is added to provide at least 0.5 ppm peroxyacid in the media often from 1 to 25 ppm. Introduction of the components to form such an amount of peroxyacid leads to a substantial reduction in the content of live microorganisms. In the event that the aqueous media contain oxidisable waste chemicals such as inorganic or organic cyanides and mercaptans and the like, at least one equivalent of activator/hydrogen peroxide should be employed per mole of oxidisable substance. The pH of such media is preferably adjusted beforehand to and maintained at the known pH for safe peroxyacid reaction with such substances e.g. above pH 9 for cyanides.

Having described the invention in general terms, specific embodiments will now be described in great detail by way of Example only.

EXAMPLES 1, 2, 3, AND 4

The activators in Examples 1 and 2 are respectively 1,1,5-triacetoxypent-4-ene, (TAPE) and 1,1,5,5-tetraacetoxypentane (QAPA). A mixture of these two activators was obtained by reacting glutaraldehyde (1 mole) with acetic anhydride (3.25 moles) sodium acetate (1.35 moles) and heated to reflux temperature of approximately 150° C. and maintained at that temperature for approximately 4 hours, by which time the sodium acetate had fully dissolved. The mixture was allowed to cool to below 100° C., in practice 70°-80° C. and then ice-water washed in order to extract any residual sodium acetate, with about half its weight of ice water. The organic layer was separated and distilled in the presence of a polymerisation inhibitor (1% w/w p-tertiary butyl catechol). At a pressure of 1 Torr and boiler/head temperatures of respectively 90°/50° C. to acetic acid and other low boiling point impurities were taken off, at 0.2 Torr and 90°-100°/35°-40° C. the monoacetate fraction was obtained, and as the temperature was raised to 110°-125°/70°-85° C. the diacetate fraction was obtained. The product of Example 1 was obtained at 0.2 Torr and 140°-160°/110°-115° C. and of Example 2 at 0.4 Torr and 180°-200°/140°-155° C. The nature of the products was checked by gas chromatograph/mass spectrometry.

EXAMPLES 5, 6 AND 7

In these Examples, the activator is respectively ethylidene diacetate (EDA), ethylidene benzoate acetate (EBA), and ethylidene dibenzoate (EDB). The activators were prepared by reacting vinyl acetate, in the case of Example 5 with acetic acid, and with benzoic acid in Example 6, and vinyl benzoate with benzoic acid in Example 7. The preparation of ethylidene benzoate acetate is described in greater detail herein and the other compounds can be made likewise but with the appropriate change to the reactants and inhibitors. A 20 liter reactor equipped with a reflux was charged with vinyl acetate (5 kg) and benzoic acid (5 kg) and copper acetate (2.5 g, polymerisation inhibitor) were stirred into the reaction mixture at ambient temperature. Further vinyl acetate (2.05 kg) was then washed in followed by acetic anhydride (0.54 kg) and the mixture heated to 45° C. Methane sulphonic acid (0.11 kg) was then introduced with vigorous stirring and the mixture was heated to reflux temperature and maintained for 6 hours. The mixture was then allowed to cool overnight, with stirring to ambient temperature.

Demineralised water (6 kg) was thoroughly stirred for 15–20 minutes with the reaction mixture and then allowed to separate. The lower organic layer was withdrawn and washed similarly with the same weight of water. In a third washing, the water contained sodium acetate (300 g) and the procedure was repeated using 120 g sodium acetate in 6 kg water until the aqueous layer had a pH of below pH 4. The final organic layer was dried over anhydrous sodium sulphate for several hours.

The organic phase was then purified by distillation under reduced pressure in the presence of p-t-Butyl catechol (20 g), first the excess vinyl acetate being removed under a moderate vacuum to about 2000–2500 Pa pressure which was subsequently evacuated to about 375 Pa pressure during the distillation of ethylidene benzoate acetate, which boiled at 95° C. approx at 375 Pa pressure. The formation of the diester was confirmed by NMR spectroscopy and gas chromatograph/mass spectrometry.

EXAMPLE 8

The general procedure of Examples 5 to 7 was repeated in a one tenth scale for the formation of ethylidene adipate diacetate (EADA) starting from vinyl acetate and adipic acid, with appropriate modifications in view of the different products obtained and omitting the final (sub 2000 Pa) low pressure distillation step.

The effectiveness of each of the Example activators at enhancing the bleaching of stains, was tested by forming a solution containing the concentration of persalts and activator specified in Table 1 together with a persalt-free detergent composition available in the USA from Procter and Gamble under the trademark TIDE (lower phosphorus content, solution concentration of 6 gpl). The solution was formed using a water supply having a hardness of 250 ppm in a weight ratio of calcium:magnesium 3:1. The washing trials were carried out at a typical hand-hot washing temperature of 40° C. at a pH maintained at pH 9 in a laboratory scale washing machine available from US Testing Corporation under the name TERGOTMETER. Swatches stained with red wine were washed in the machine, and removed after respectively 10 or 20 minutes washing and then rinsed and dried. The reflectance of the washed swatch was then measured and compared with the unwashed swatch and the pre-stained swatch. The reflectance measurements were obtained using an Instrumental Colour System MICROMATCH reflectance spetrophotometer equipped with a Xenon lamp fitted with a D65 conversion filter to approximate CIE artificial daylight, i.e. wavelengths below 390 nm being excluded. The percentage stain removal was calculated from the reflectance readings using the formula:

$$\% \text{ stain removal} = 100 \times (R_w - R_s)/(R_u - R_s)$$

in which $R_w$, $R_s$, and $R_u$ represent respectively the reflectance of the washed sample, the stained sample before washing and the sample before staining.

The results of the trials are summarised in the Table below. In each case, Table 1 specifies the measured avox concentration provided by the persalt, sodium perborate tetrahydrate. It will be recognised that an avox concentration of 35 ppm corresponds to a molar concentration of $2.2 \times 10^3$M hydrogen peroxide.

TABLE 1

| Activator Name | Conc. ppm | Avox Conc. ppm | Mole ratio | % Removal after 10 mins | % Removal after 20 mins |
|---|---|---|---|---|---|
| | 35 | | 47 | 55 | |
| TAPE | 250 | 35 | 0.47:1 | 60 | 67 |
| TAPE | 540 | 35 | 1:1 | 65 | 70 |
| QAPA | 250 | 35 | 0.38:1 | 64 | 70 |
| QAPA | 665 | 35 | 1:1 | 60 | 65 |
| | | 100 | | 60 | 66 |
| QAPA | 665 | 35 | 1:1 | 70 | 75 |
| QAPA | 333 | 35 | 0.5:1 | 70 | 73 |
| QAPA | 166 | 35 | 0.25:1 | 67 | 70 |
| | | 100 | | 60 | 66 |
| EDA | 319 | 35 | 1:1 | 69 | 72 |
| EDA | 160 | 35 | 0.5:1 | 66 | 69 |
| EBA | 455 | 35 | 1:1 | 70 | 72 |
| EBA | 228 | 35 | 0.5:1 | 67 | 70 |
| | | 35 | | 47 | 55 |
| EDB | 295 | 35 | 0.5:1 | 69 | 73 |
| | | 35 | | 48 | 53 |
| EADA | 220 | 35 | 1:1 | 58 | 62 |

From the foregoing Table 1, it will be recognised that the activators enhance the stain removing capability of a persalt at typical hand hot washing temperatures. And advantageously similar results can be obtained even at low mole ratios as at the mole ratio of 1:1. When various of the processes were tried at pH 8 instead of pH 9, even in the presence of a substantially lower concentration of detergent base, 1.5 gpl instead of 6 gpl, at least as good if not better stain removal occurred. At 35 ppm avox and a mole ratio of 0.5:1 for EBA, 70/75% stain removal occurred after 10/20 minutes and at the 1:1 mole ratio 74/78% stain removal occurred. Correspondingly good performance was obtained when the other activators were employed at pH 8.

EXAMPLES 9 AND 10

In these Examples, two aqueous acidic emulsions were made by the following method.

An organic phase was obtained by stirring all the emulsifiers and in the parts by weight specified in Table 2 with the activator obtained from Example 6, at approximately ambient temperature to form an homogenous mix. An aqueous phase was obtained by diluting technical grade hydrogen peroxide (35% w/w) with demineralised water to give the parts by weight specified in Table 2. The aqueous phase was then gradually introduced into the organic phase with vigorous stirring over a period of about 5 minutes by which time an emulsion had formed. Substantially similar emulsions were obtained when part of the emulsifiers were introduced first into the aqueous phase. In the emulsions the emulsifiers were as follows:

E1 nonylphenol ethoxylate (SYNPERONIC NP13 from ICI plc)

E2 dialkyl sulphosuccinate (AEROSOL OT75 from Cyanamid)

E3 N-alkyl sulphosuccinamate (AEROSOL A22 from Cyanamid)

The quantities given in Table 2 are in parts by weight.

TABLE 2

| Component | Example No. 9 | Example No. 10 |
|---|---|---|
| EBA | 20 | 20 |
| E1 | 10 | 8 |

TABLE 2-continued

| Component | Example No. 9 | 10 |
|---|---|---|
| E2 | 6 | 4 |
| E3 | — | 4 |
| $H_2O_2$ | 7 | 7 |
| $H_2O$ | 57 | 57 |

Clear dispersions were obtained indicating that microdroplets of the organic phase had been obtained.

Further trials of emulsions of EBA or other activators and hydrogen peroxide used in an amount to generate in the wash solution 10 ppm of peracid Avox were carried out at 40° C. using a medium wash in a domestic top-loader automatic washing machine, of 47 liter capacity from Maytag in the USA, in conjunction with the above mentioned low phosphorus detergent composition TIDE at 1.5 g/l concentration. The stain removal from prestained swatches of cotton or polycotton cloth mixed in with the rest of a medium soil wash load were tested in the manner outlined hereinbefore. The results are summarised in Table 3, in comparison with corresponding vinyl benzoate (VB) or vinyl acetate (VA) products. A −ve sign indicates net stain darkening.

TABLE 3

| Cloth | Stain | % Stain Removal using VB | VA | EBA |
|---|---|---|---|---|
| Cotton | Red Wine | 57 | 52 | 57 |
| | Coffee | 52 | 50 | 53 |
| | Bilberry | 68 | 62 | 64 |
| | Tea | 20 | 22 | 25 |
| | Cocoa | 15 | 15 | 15 |
| | EMPA 101 | 32 | 29 | 32 |
| | Clay | 78 | 76 | 77 |
| Polycotton | Red Wine | 14 | 10 | 16 |
| | Coffee | 42 | 40 | 45 |
| | Bilberry | 36 | 26 | 33 |
| | Tea | −4 | −7 | 1 |
| | Clay | 66 | 65 | 64 |

Table 3 indicates that EBA performed on balance as well as the other two products tested but advantageously, EBA has substantially little or no malodour and has a very high flash point so that its formulation, transportation and use is not hindered to the extent that VB or VA are hindered.

EXAMPLES 11 TO 20

The following Examples 11–20 were obtained by first forming a solution of the entire amount of the emulsifier in an aqueous hydrogen peroxide solution (8.4% w/w) into which the selected amount of activator was then introduced with vigorous mixing. The mixture was then allowed to stand without stirring and its appearance was noted after 30 minutes.

Examples 26 to 30 were performed similarly to Examples 11 to 22 with the interpolation of an extra step after a solution of the first indicated emulsifier had been obtained. In that extra step the desired amount of the second emulsifier/cosurfactant was introduced, with the result that the concentration of hydrogen peroxide was lowered proportionately below 8.75% w/w, and the concentration of the first emulsifier likewise.

The emulsifiers used were:

$E_a$—linear alkyl benzene sulphonate (NANSA SS30)
$E_b$—alkyl sulphate (sodium lauryl sulphate)
$E_c$—alcohol ethoxylate (ETHYLAN CD919)
$E_d$—nonyl phenol ethoxylate (SYNPERONIC NP13)
$E_e$—2:2:1 w/w mix of a linear alkyl benzene sulphonate/alcohol sulphate/alcohol ether ethoxylate
$E_f$—n-pentanol as co-emulsifier
$E_g$—linear alkyl benzene sulphonate (ARYLAN CA)
$E_h$—dialkyl sulphosuccinate (AEROSOL MA80)
$E_i$—nonyl phenol ethoxylate (SYNPERONIC NP10)

The various compositions are summarised in Table 4 below, all of which were visually clear after 30 minutes. The %s are those of the final composition, not parts added to 100 parts of aqueous hydrogen peroxide.

TABLE 4

| Example | Activator | (% w/w) | Emulsifier | % w/w |
|---|---|---|---|---|
| 11 | EADA | 5 | $E_a$ | 20 |
| 12 | EDA | 12 | $E_b$ | 12 |
| 13 | EDA | 15 | $E_b$ | 18 |
| 14 | EDA | 8 | $E_c$ | 12 |
| 15 | EDA | 14 | $E_c$ | 19 |
| 16 | EDA | 10 | $E_d$ | 12 |
| 17 | EDA | 13 | $E_d$ | 19 |
| 18 | EDA | 11 | $E_e$ | 12 |
| 19 | EDA | 18 | $E_e$ | 18 |
| 20 | EBA | 4 | $E_a$ | 20 |
| 21 | EBA | 7 | $E_b$ | 19 |
| 22 | EBA | 5 | $E_c$ | 20 |
| 23 | EBA | 13 | $E_d$ | 18 |
| 24 | EBA | 4 | $E_e$ | 13 |
| 25 | EBA | 13 | $E_b/E_g$ | 10/21 |
| 26 | EBA | 13 | $E_c/E_h$ | 10/22 |
| 27 | EBA | 15 | $E_d/E_h$ | 10/21 |
| 28 | EBA | 8 | $E_h/E_i$ | 13/8 |
| 29 | EBA | 10 | $E_c/E_h$ | 12/13 |
| 30 | EBA | 11 | $E_h/E_c$ | 11/14 |

From Table 4, it can be seen that many clear compositions can be obtained even using anionic emulsifiers with the activators described herein. Many of these Examples have been repeated but at lower concentrations of emulsifier. In general it was found that nearly proportionate amounts of activator could be accommodated whilst still obtaining a clear emulsion, as can be seen also by comparing Examples 15 and 16, or 17 and 18 etc. Various other emulsifiers were tried and as a general rule it was found that performance ran parallel with their representative specified in Table 4. Thus, by way of example, other alcohol ethoxylates with a different degree of ethoxylation and/or derived from a different alcohol also produced an emulsion, but usually the maximum ratio of activator to emulsifier from which a clear composition resulted was not the same.

EXAMPLES 31, 33 AND COMPARISONS 32, 34

In these Examples and comparisons, aqueous microemulsions were made by the general method for Examples 26 to 30 and having composition differences given in Table 5. Each microemulsion contained 15.6% w/w activator and 5.1% w/w $H_2O_2$ (as 100%). Comparison activator chloral diacetate is designated by CDA, $E_j$ is an alcohol ethoxylate (ETHYLAN CD916) and other abbreviations are as in Table 4.

The compositions were stored in sealed bottles at 28° C. and periodically analysed for activator content and total avox. The residual concentrations of $H_2O_2$ and activator after 2 weeks are also given in Table 5.

TABLE 5

| Ex Comp | Activator | Emulsifiers Name | % w/w | Residual % w/w Activator | $H_2O_2$ |
|---|---|---|---|---|---|
| 31 | EBA | $E_j/E_h$ | 19/11.5 | 13.2 | 4.8 |
| C32 | CDA | $E_j/E_h$ | 19/11.5 | 0.4 | 3.3 |
| 33 | EBA | $E_g/E_i$ | 13/12 | 13.7 | 5.2 |

TABLE 5-continued

| Ex | | Emulsifiers | | Residual % w/w | |
|---|---|---|---|---|---|
| Comp | Activator | Name | % w/w | Activator | $H_2O_2$ |
| C34 | CDA | $E_g/E_i$ | 13/12 | 0.1 | 3.3 |

Clear gassing was also observed from C32 and C34 turned yellow, whereas Example 31 and 33 compositions remained clear.

It can be concluded from Table 5 that the prior art activator chloral diacetate is most unsuitable for incorporating in aqueous peroxidic emulsions in that its rate of loss during storage was very much faster than for the directly comparable invention compositions.

EXAMPLES 35–39

In these Examples, a further range of gem-diester activators was made.

In Example 35, a three necked flask (250 mls) equipped with a condenser and thermometer was charged at ambient temperature with cyclohexane carboxylic acid (100 g) a catalyst system comprising acetic anhydride (2 g) copper acetate (0.1 g) and methane sulphonic acid (1.75 g) was added with stirring. Vinyl acetate (100 g) was added over a 30 minute period and the mixture heated to 75° C., where it was held for 12 hours. The mixture was subsequently filtered, fractionally distilled under a partial vacuum to 55 Pa, from which two major fractions were separated. Both were then washed with a dilute sodium bicarbonate solution, washed with water and dried over anhydrous sodium sulphate. Lower boiling point fraction (34.8 g) 98° C. was analysed by GC and IR and was ethylidene cyclohexane carboxylate acetate.

In Examples 36–39, the gem-diesters were similarly made to Example 35 by charging the three necked flask (200 mls) with the selected aliphatic acid (100 g), respectively heptanoic, octanoic, trimethyl-hexanoic and 2-ethyl-hexanoic acid, and perchloric acid (0.05 g) added as a catalyst. The mixture was warmed to 40° C. and vinyl acetate (120 g) added over a 30 minute period with stirring. The mixtures were then held at 100° C. and stirred until GC analysis showed that the reaction was substantially completed. This period comprised 5½ hours on Ex 36, 9 hours in Ex 37, 1½ hours in Ex 38, and 3 hours in Ex 39. The mixture was then neutralised with sodium acetate (0.1 g) and residual vinyl acetate removed on a rotary evaporation at 35° C. The resultant liquid product was then fractionally distilled under a pressure of about 55 Pa. The boiling point fraction corresponding to the mixed di-ester, i.e. containing one acetate and one longer chain aliphatic carboxylate group was isolated and dried as above.

The effectiveness of the products of Examples 35 to 39 as peroxyacid generators was demonstrated by standard washing trials conducted similarly to the trials, the results of which are summarised in Table 1, with the exception that the stain was bilberry on cotton, and the detergent base comprised 6 gpl of IEL base. In each trial the wash solution contained 0.337 gpl of sodium perborate tetrahydrate providing peroxide in an equivalent mole ratio to the peroxyacid generator of 1:1. Stain removal was determined in the same way as in the beforementioned trials and the results after 20 minutes washing are shown in Table 6 below. The comparison was carried out under exactly the same conditions but without added peroxyacid generator.

TABLE 6

| Product of | % Stain Removal |
|---|---|
| Ex 35 | 83 |
| 36 | 83 |
| 37 | 80 |
| 38 | 79 |
| 39 | 76 |
| Comp | 69 |

It is readily apparent that substantial generation of peroxyacid has been obtained.

EXAMPLES 40 TO 43

In these Examples further emulsions, macroemulsions in 40 and 41, and microemulsions in 42 and 43, were made following the general method for Examples 9 and 10, using the activator and emulsifiers specified in Table 7 below. The abbreviations are as specified earlier with the addition of EEHA—ethylidene 2-ethyl hexanoate acetate
$E_k$—primary alcohol ethoxylate (SYNPERONIC A7)
$E_l$—diethanolamine laurate
$E_m$—nonyl phenol ethoxylate (SYNPERONIC NP8)

TABLE 7

| Ex No. | 40 | 41 | 42 | 43 |
|---|---|---|---|---|
| Component | % w/w in the composition | | | |
| EBA | 10 | 16 | — | — |
| EEHA | — | — | 9 | 9 |
| E2 | — | — | 13 | 9.5 |
| $E_a$ | — | 14 | — | — |
| $E_i$ | — | — | 9 | — |
| $E_k$ | 10 | — | — | — |
| $E_l$ | 5 | — | — | — |
| $E_m$ | — | — | — | 13 |
| $H_2O_2$ | 2.5 | 6.7 | 3 | 3.5 |
| Water | balance | | | |

EXAMPLES 44 TO 53

In these Examples, solutions containing aqueous hydrogen peroxide, gem diester activator and glycolic solvent, optionally containing a surfactant were made by first mixing the selected solvent with any surfactant used, then introducing the selected activator (EBA) and mixing in the 35% w/w aqueous hydrogen peroxide and any extra demineralised water needed. The process was carried out at ambient temperature.

The compositions are summarised in Table 8, all percentages therein being by weight of the composition.

The components are abbreviated as follows:

EHA ethylidene heptanoate acetate
$S_1$ Dipropylene glycol
$S_2$ 2-acetoxyethanol
$S_3$ polyethylene glycol av mol wt 400
$S_4$ polyethylene glycol av mol wt 200
$S_5$ 2-butoxyethanol
$S_6$ dodecyl benzene sulphonic acid, triethanolamine salt
$S_7$ dodecyl benzene sulphonic acid/isopropylamine

TABLE 8

| Ex No | $H_2O_2$ % | $H_2O$ % | Activator % | Solvent Type | Solvent % |
|---|---|---|---|---|---|
| 44 | 5 | 18 | EBA 20 | $S_1$ | 57 |
| 45 | 7 | 13 | EBA 20 | $S_2$ | 60 |
| 46 | 4 | 7 | EBA 27 | $S_3$ | 62 |
| 47 | 3 | 12 | EBA 12 | $S_4$ | 73 |
| 48 | 5 | 22 | EBA 15 | $S_3/S_6$ | 29/29 |
| 49 | 6 | 32 | EBA 12 | $S_3/S_7$ | 25/25 |
| 50 | 5 | 10 | EBA 29 | $S_2$ | 56 |
| 51 | 4 | 12 | EHA 20 | $S_5$ | 64 |

TABLE 8-continued

| Ex No | $H_2O_2$ % | $H_2O$ % | Activator % | Solvent Type | Solvent % |
|---|---|---|---|---|---|
| 52 | 4.5 | 22.5 | EHA 14 | $S_5$ | 63 |
| 53 | 4 | 13 | EHA 14 | $S_1$ | 69 |

Many other formulations corresponding to Examples 44 to 53 were made in which the solvent % was higher and the EBA and $H_2O_2/H_2O$ proportions were proportionately lower. All of them were one phase solutions.

The storage stability of Examples 44 and 45 was tested by storing a sample of each in loosely fitting screw-capped polythene bottles at 37° C., and the residual avox content and EBA content determined at intervals. After two weeks storage, the loss of avox was less than 3% and the loss of activator ranged from 2½% to all apparent gain, even when allowance had been made for any loss of solvent from the composition. By comparison, corresponding compositions in which all the $H_2O_2$ had been replaced by water showed noticeably worse loss of activator, showing that once again intimate contact between a peroxide and this type of activator has not led to premature and mutually destructive interaction, even though such interaction in subsequent use is the objective.

EXAMPLES 54 TO 59

In these Examples and comparison, non-aqueous liquid washing compositions were made by mixing together at about 40° C. the specified anionic surfactant, nonionic surfactant and solvent in the weight ratio shown in Table 9. Thereafter, any activator was mixed in and finally the finely ground particulate solids were introduced.

The various ingredients are abbreviated as follows:

SO polyethylene glycol (400 MW)
SN alcohol ethoxylate (NEODOL 91-8)
SA isopropylamine alkyl benzene sulphonate (NANSA YS94)
SB alcohol ethoxylate (SYNPERONIC A7)
BA ethylidene benzoate acetate
BP sodium perborate monohydrate
CP sodium tripolyphosphate solid
CZ sodium zeolite A
CS sodium silicate
DS carboxymethyl cellulose
DO optical brightener
DD silica powder (AEROSIL 200)
DE ethylene diamine tetraacetate (Na salt)

TABLE 9

| Ingredient Name | % w/w in Example/Comparison No. 54 | 55 | 56 | 57 | 58 | 59 | C60 |
|---|---|---|---|---|---|---|---|
| SO | 50 | 45 | 35 | 35 | 35 | — | — |
| SN | 25 | 15 | 20 | 10 | 10 | 8 | 9 |
| SA | — | 15 | — | 10 | 10 | — | — |
| SB | — | — | — | — | — | 34 | 40 |
| BA | 15 | 15 | 15 | 15 | 15 | 15 | — |
| BP | 10 | 10 | 10 | 10 | 10 | 10 | — |
| CP | — | — | 20 | 20 | — | 26 | 33 |
| CZ | — | — | — | — | 20 | — | — |
| CS | — | — | — | — | — | 4 | 4 |
| DS | — | — | — | — | — | 1 | 1 |
| DO | — | — | — | — | — | 1 | 1 |
| DD | — | — | — | — | — | — | 1 |
| DE | — | — | — | — | — | 1 | 1 |

The effectiveness of the compositions was measured by washing swatches of cotton prestained with red wine at 40° C. for 10 or 20 minutes, at a concentration of 2 g/l in hand water (250 ppm hardness Ca:Mg weight ratio of 3:1) using a laboratory scale washing machine sold under the name TERGOMETER by the US Testing Corporation, a machine which simulates a vertical agitator domestic washing machine. After being washed, each swatch was rinsed with cold water and air dried. The reflectance of each swatch was then measured ($R_f$) and compared with its unwashed reading ($R_i$) and the prestained reading for the swatch ($R_u$). From the measurement the % Stain Removal was calculated using the formula:

$$\% \text{ Stain Removal} = 100 \times (R_f - R_i)/(R_u - R_i)$$

The results are given in Table 2 below, together with the measured pH of the wash water before and after the wash and with comparison washes C61 and C62 using 6 g/l of respectively a particulate automatic heavy duty washing composition available in England in Spring 1983 from Unilever under the brand name PERSIL Automatic and a liquid heavy duty washing composition available in France in Spring 1983 also from Unilever under the brand name WISK.

By way of guidance Examples 54 to 59 each provided an avox concentration of 23 ppm peroxyacid avox.

TABLE 10

| Example/ Comparison | pH start | pH end | % Stain Removal 10 mins | % Stain Removal 20 mins |
|---|---|---|---|---|
| 54 | 8.5 | 7.2 | 61 | 67 |
| 55 | 8.5 | 7.0 | 59 | 63 |
| 56 | 8.4 | 7.2 | 66 | 73 |
| 57 | 8.5 | 7.1 | 67 | 72 |
| 58 | 8.7 | 7.1 | 61 | 66 |
| 59 | 8.8 | 7.4 | 68 | 74 |
| C60 | 9.3 | 9.2 | 49 | 52 |
| C61 | 10.3 | 10.0 | 56 | 63 |
| C62 | 8.5 | 8.5 | 56 | 62 |

From Table 10, it can be seen that all the invention compositions performed in the tests considerably better than the direct comparison C60 even when using unbuilt formulations, and all matched or substantially improved upon the two commercial products C61 and C62 even though the latter were used at thrice the concentration of the invention compositions.

EXAMPLES 63 AND COMPARISONS 64 AND 65

In this Example, the antimicrobial activity of the hydrogen peroxide/peroxyacid generator system is demonstrated. The Example employed a microemulsion containing 5% w/w EBA, 2% w/w hydrogen peroxide and 13% w/w a nonyl phenol ethoxylate available under the trademark SYNPERONIC (grade NP13), with the balance being demineralised water. In comparison 64 the hydrogen peroxide was omitted from an otherwise identical emulsion and in Comparison 65, a simple 2% hydrogen peroxide solution was used.

In each trial, a solution of one of the standard macroemulsions listed below was dosed into the liquid biocide to provide an initial concentration of $10^6$ to $10^7$ mfu $ml^{-1}$.

Micro-organisms:

Ec *Escherichia coli* NCTC 8196 (faecal organism)
Pa *Pseudomonas aeruginosa* ATCC 15442 (Urinary tract pathogen
Sa *Staphylococcus aureus* ATCC 6538 (skin organism)
Sf *Streptococcus faecalis* ATCC 10541 (faecal organism)

Ca *Candida albicans* ATCC 10231 (vaginal pathogen)
Bs *Bacillus subtilis* NCTC 10452 (spore former)

Five different treatment regimes were employed, as listed below. In A to C biocide was used in progressively more dilute form and in D and E the effect of organic contamination is simulated.

Treatment regimes:

A Biocide: neat×0.9
B Biocide: neat×0.5
C Biocide: neat×0.1
D Biocide: neat×0.25; 2.5% (w/w) yeast extract present
E Biocide: neat×0.1; 4.0% (w/w) yeast extract present All the trials were conducted at laboratory ambient temperature (about 20°-25° C.). At intervals 1 ml samples were withdrawn after 5, 10, 30 minutes and 1, 2, 4, 7, 18 and 24 hours. The 5 and 10 minute samples were not taken for Bs. Each sample was neutralised (with 0.025% catalase when $H_2O_2$ was present, and/or with 3% nonionic surfactant TWEEN when EBA was present) and the residual number of microorganisms determined by incubating the sample on agar plates for 48 hours at 37° C.

The residual and initial numbers of microorganisms were compared, and the contact time necessary to achieve a reduction of 99.99% of viable microorganisms is listed in Table 11 below. K indicates that the 99.99% kill was achieved in less than 5 minutes and k in less than 15 minutes for Bs. Other times shown are the first measurement indicating that the desired kill had been achieved and the actual time is between that and the preceding contact time. NA indicates that the desired kill was not achieved even after 24 hours, and a - indicates that no trial was conducted.

TABLE 11

| | | Minimum Contact Time | | |
|---|---|---|---|---|
| Species | Treatment | Ex 63 | C64 | C65 |
| Ea | A | K | 2 hr | 10 min |
| | B | K | — | 30 min |
| | C | K | — | — |
| | D | K | — | 30 min |
| | E | K | — | — |
| Pa | A | K | 30 min | 5 min |
| | B | K | — | NA |
| | C | K | — | — |
| | D | 10 min | — | NA |
| | E | 30 min | — | — |
| Sa | A | K | 7 hr | 10 min |
| | B | K | — | NA |
| | C | F | — | — |
| | D | 2 hr | — | NA |
| | E | 4 hr | — | — |
| Sf | A | K | 18 hr | 30 min |
| | B | K | — | 1 hr |
| | C | K | — | — |
| | D | 1 hr | — | 30 min |
| | E | 12 hr | — | — |
| Ca | A | K | NA | 2 hr |
| | B | K | — | 7 hr |
| | C | 2 hr | — | — |
| | D | 2 hr | — | 4 hr |
| | E | 4 hr | — | 24 hr |
| Bs | A | k | NA | 24 hr |
| | B | k | — | NA |
| | C | 4 hr | — | — |
| | D | 7 hr | — | NA |
| | E | 24 hr | — | — |

From Table 11 it can clearly be seen that the invention product was markedly more effective than both of the comparison products, i.e. products from which either hydrogen peroxide or the peroxyacid generator was omitted. Secondly, the invention product was able to render non-viable a range of commonly encountered microorganisms, thereby demonstrating its effectiveness as a household disinfectant for all surfaces, including toilets, and likewise for aqueous media such as recirculating water.

I claim:

1. A process for the generation of a peroxyacid species comprising the step of bringing into contact hydrogen peroxide or an adduct thereof or some other compound which develops hydrogen peroxide, with a peroxyacid generator having the general formula (I)

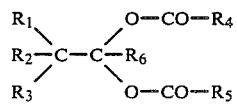

(I)

in which $R_1$ $R_2$ and $R^6$ are each selected from hydrogen and lower alkyl groups, and $R_3$ is selected from hydrogen, lower alkyl and aryl groups and groups of formula (II) or (III)

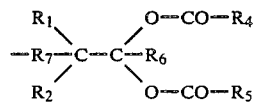

(II)

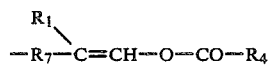

(III)

in which $R_7$ represents a carbon-carbon bond or an alkylene diradical, $R_4$ and $R_5$ each represent hydrogen or a lower alkyl, or an aryl, aralkyl or alkaryl group and $R_5$ can also be a from group of formula (IV) —$R_8$—CO—O—$R_9$ in which $R_8$ represents an alkylene diradical and $R_9$ represents a vinyl or alkyl substituted vinyl group or group of formula (V)

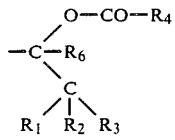

(V)

2. A composition comprising (a) hydrogen peroxide or an adduct thereof or a compound which develops hydrogen peroxide and (b) a peroxyacid generator having the general formula (I) as described in claim 1.

3. A composition according to claim 2 in which $R_1$ and $R_2$ in Formula I each represent hydrogen and $R_3$ and $R_6$ each represent hydrogen or a lower alkyl group.

4. A composition according to claim 2 in which $R_3$ represents a group of formula II or III in which $R_7$ represents a diradical comprising 1, 2 or 3 linear carbon atoms, unsubstituted or further substituted by one or more $C_1$-$C_4$ alkyl groups.

5. A composition according to claim 4 in which $R_1$, $R_2$ and $R_6$ represent hydrogen.

6. A composition according to claim 2 in which $R_4$ represents hydrogen or a lower alkyl or phenyl or substituted phenyl group.

7. A composition according to claim 2 in which $R_5$ represents a lower alkyl or phenyl or substituted phenyl group.

8. A composition according to claim 2 in which $R_5$ represents an alkylene diradical containing from 2 to 10 linear carbon atoms, unsubstituted or substituted by one or more $C_1$–$C_4$ alkyl groups.

9. A composition according to claim 8 in which $R_5$ represents a $C_4$ to $C_8$ polymethylene diradical.

10. A composition according to claim 3, in which $R_4$ represents a methyl or phenyl group.

11. A composition according to claim 2 in which the peroxyacid generator is selected from 1,1,4-triacetoxy but-3-ene, 1,1,4,4-tetraacetoxybutane, 1,1,5-triacetoxy-pent-4-ene and 1,1,5,5-tetraacetoxypentane.

12. A composition according to claim 3 in which the peroxyacid generator is selected from ethylidene diacetate, ethylidene dibenzoate, ethylidene benzoate acetate, and the three corresponding isopropylidene esters.

13. A composition according to claim 10 in which the peroxyacid generator is selected from ethylidene adipate diacetate and ethylidene azelate diacetate.

14. A composition according to claim 2 in which either of $R_4$ and $R_5$ represents a $C_5$–$C_9$ chain length alkyl or cycloalkyl group and the other represents a $C_1$–$C_4$ alkyl or phenyl group.

15. A composition according to claim 14 in which the one of $R_4$ and $R_5$ is selected from cyclohexyl, pentyl hexyl or heptyl groups unsubstituted or alkyl substituted to provide $C_5$ to $C_9$ atoms in the group.

16. A composition according to claim 15 in which the peroxyacid generator is selected from ethylidene cyclohexane carboyxlate acetate, ethylidene heptanoate acetate, ethylidene octanoate acetate and ethylidene 2-ethylhexanoate acetate.

17. A composition according to claim 2 in which the peroxyacid generator and hydrogen peroxide or generator thereof are brought into contact in an equivalent mole ratio of from 2:1 to 1:2.

18. A composition according to claim 2 which is in the form of aqueous acidic emulsion of hydrogen peroxide, the peroxyacid generator and an emulsifying amount of an emulsifier.

19. A composition according to claim 18 in which the aqueous phase has a pH of from 2 to 5.

20. A composition according to claim 18 in which the peroxyacid generator and hydrogen peroxide are present in an equivalent ratio of from 1:1 to 2:3.

21. A composition according to claim 18, in which the concentration of hydrogen peroxide therein is from 1 to 20% by weight thereof.

22. A composition according to claim 21 in which the concentration of hydrogen peroxide therein is from 4 to 8% by weight thereof.

23. A composition according to claim 18 in which the proportion of peroxyacid generator therein is from 1 to 35% by weight thereof.

24. A composition according to claim 23 in which the amount of emulsifier employed is from 10 to 70% by weight of the peroxyacid generator.

25. A composition according to claim 18 comprising 3 to 20% hydrogen peroxide, 30 to 85% water, 10 to 30% peroxyacid generator, and from 10 to 70 parts by weight of emulsifier per 100 parts by weight of peroxyacid generator, the aqueous phase having a pH of from 2 to 5.

26. A composition according to claim 23 which contains a water soluble emulsifier in at least the weight of the activator.

27. A composition according to claim 26 in which the proportion of activator is from 1 to 15% w/w and the proportion of emulsifier is selected in the range of 5 to 30%.

28. A composition according to claim 18 which contains sufficient emulsifier for the emulsion to be visually clear.

29. A composition according to claim 18, in which the emulsifier is selected from water-soluble alcohol ethoxylates, alkyl phenol ethoxylates, elcohol sulphates, linear alkyl benzene sulphonates and alkyl esters of sulphosuccinates.

30. A composition according to claim 18, which contains an aliphatic alcohol having a $C_4$–$C_8$ carbon chain in a weight ratio to the emulsifier of up to 2:1.

31. A composition according to claim 18 which, when plotted on triangular coordinate graph paper for respectively weight percent of aqueous hydrogen peroxide, activator and emulsifier is within the quadrilateral having apex coordinates of 65,10,25; 45,30,25; 25,15,60; 30,10,60.

32. A composition according to claim 2 in which the composition is in the form of a solution of aqueous acidic hydrogen peroxide and of the peroxyacid generator in a solvent comprising a glycol, or glycerol or oligomer of short chain glycols, or short chain aliphatic ether or ester derivatives, said solvent having a molecular weight of from 125 to 450.

33. A composition according to claim 32 in which the solvent is selected from polyethylene glycol of average molecular weight 200–400, di or triethylene glycol and their monoacetate or monopropionate derivatives and the monopropyl or monobutyl ether of ethylene glycol diethylene glycol or propylene glycol or mixtures of two or more thereof.

34. A composition according to claim 32 in which the solvent contains up to twice its weight of an anionic or nonionic surfactant.

35. A composition according to claim 32 which comprises at least 55% w/w solvent/surfactant, and up to 35% w/w activator and up to 40% w/w aqueous hydrogen peroxide.

36. A composition according to claim 32 in which the concentration of hydrogen peroxide based on the aqueous hydrogen peroxide component is from 10 to 30% w/w.

37. A composition according to claim 32 which when plotted on triangular coordinate paper as respectively weight percent of aqueous hydrogen peroxide, activator, solvent/surfactant are in the pentagonal area defined by the points 30,15,55, 20,25,55; 10,20,70; 10,10,80; 30,10,60.

38. A washing composition comprising a substantially non-aqueous liquid component containing at least one surfactant in which is dissolved a peroxyacid generator as described in claim 1 and in which is suspended a hydrogen peroxide developing persalt.

39. A composition according to claim 38 in which from 5 to 95% w/w of the liquid component comprises a solvent selected from liquid alcohols, polyols, polyglycols, aminoalcohols, ester or ether derivatives of the hydroxyl groups, or amines, or N-acyl or N-alkyl derivatives of aminoalcohols.

40. A composition according to claim 38 in which the liquid component contains at least one non-ionic surfactant and at least one anionic surfactant.

41. A composition according to claim 38 in which the persalt is sodium perborate monohydrate.

42. A composition according to claim 38 containing from 5 to 30 parts by weight activator, from 5 to 20 parts by weight persalt, from 0 to 30 parts by weight builder and 0 to 10 parts by weight auxiliaries, the solids comprising from 5 to 15% by weight of the composition and the solvent/surfactant mixture provides the balance.

43. A process for washing an article or surface in which the latter is brought into contact with a composition as described in claim 2, in the presence of a surfactant.

44. A process according to claim 43 which is effected at a pH of 7.5 to 10.

45. A process for disinfecting a medium in which a composition according to claim 1 is brought into contact with that medium.

46. A process according to claim 45 which is effected at a pH of from 3 to 9.

* * * * *